US005209469A

United States Patent [19]

Laskowitz et al.

[11] Patent Number: 5,209,469

[45] Date of Patent: May 11, 1993

[54] GOLFER'S TOOL

[76] Inventors: Danny Laskowitz; Marlene Laskowitz, both of 2015 Bob O'Link La., Palm Springs, Calif. 92264

[21] Appl. No.: 724,875

[22] Filed: Jul. 2, 1991

Related U.S. Application Data

[62] Division of Ser. No. 568,966, Aug. 17, 1990, Pat. No. 5,029,854.

[51] Int. Cl.[5] ..... A63B 57/00

[52] U.S. Cl. ..... 273/32 B; 172/378

[58] Field of Search ..... 273/32 R, 32 H, 32 B, 273/162 R, 162 F, 32 A, 32 F; 254/18, 133 R; 172/378, 379, 380; 40/317, 334, 299

[56] References Cited

U.S. PATENT DOCUMENTS

| | | | |
|---|---|---|---|
| 1,093,946 | 4/1914 | Platt | 254/18 |
| 1,499,181 | 6/1924 | Mills | 254/133 R X |
| 2,583,945 | 1/1952 | Jacobs | 254/133 R X |
| 3,310,879 | 3/1967 | Brzezinski et al. | 273/32 B X |
| 4,884,805 | 12/1989 | Patterson | 273/32 B |
| 4,951,951 | 8/1990 | Meyer | 273/32 B X |
| 4,984,790 | 1/1991 | Dowdy et al. | 273/32 B |
| 5,029,854 | 7/1991 | Laskowitz et al. | 273/32 B |

*Primary Examiner*—George J. Marlo

[57] ABSTRACT

A light weight, highly visible tool with no moving parts for repairing ball marks on golf course greens without the user bending over. User holds grip and pushes tines into surface of ground. User manipulates shaft causing multi-faceted curved fulcrum head including upwardly diverging side surfaces to provide leverage for repairing ball marks quickly, quietly, and without up and down movements. Tines, base, multi-faceted curved fulcrum head, collar, and neck are cast together forming a one piece tool. Neck fits and is affixed inside shaft up to collar. Grip is affixed to cover the opposite end of shaft. Flag fits around shaft and is held in place by grip and ring. With tines inserted into the ground, the shape of multi-faceted curved fulcrum head allows entire tool to stand by itself.

4 Claims, 2 Drawing Sheets

GOLFER'S TOOL

RELATED APPLICATION

This application is a division of U.S. patent application Ser. No. 07/568,966 filed Aug. 17, 1990, now U.S. Pat. No. 5,029,854.

BACKGROUND—FIELD OF INVENTION

This invention relates to golf equipment, specifically a versatile golf green repair tool.

BACKGROUND—DESCRIPTION OF PRIOR ART

Heretofore there have been many different devices used to repair ball marks on golf course greens. These devices consisted of small pocket types to be carried by golfers and heavy, large, and mechanical types designed for golf course maintenance personnel. These have known limited success. Golf course greens receive hundreds of impacts from golf balls each day. Articles in golfing journels and other media attempt to inform and educate the golfers about this growing maintenance problem. Ball marks on golf course greens continues to be a major maintenance problem. A ball mark left unrepaired for The small pocket type devices heretofore known suffer from a number of disadvantages:

(a) One major disadvantage of the small pocket type device is golfers must bend over, down to the ground to use it. Bending over may sound easy, but it becomes tiresome, strenuous, and time consuming.

(b) Bending over to fix ball marks can also be distracting while someone else is putting.

(c) In addition, golfers just plain forget to fix ball marks. The "Golfers Helper" U.S. Pat. No. 3,120,388 to Doble Feb. 4, 1964, attempted to solve the golfers memory problem by attaching a magnetic ball marker to the small pocket type device. Although this may help somewhat with his own memory, it did not solve the bending problem and did not visually remind other golfers.

(d) Dirt and chemicals from greens are put into golfers pockets when the small pocket type devices are used.

(e) Due to size, small pocket type devices are often lost or misplaced. Then a tee is substituted, which is an inadequate tool for fixing ball marks.

(f) The small pocket type devices do not provide leverage necessary to adequately repair ball marks. The golfer is left using his finger as a fulcrum.

(g) These small pocket type devices when used for advertising do not work because they are unseen in the golfers pocket.

The difficulty of bending over to fix ball marks was recognized long ago. It brought about the development of various heavy, large, and mechanical type devices. These include, "Implement for Removing Indentations from Putting Greens", U.S. Pat. No. 2,585,298 to Coelho Feb. 12, 1952, "The Golf Course Divot Replacing Tool", U.S. Pat. No. 2,869,915 to Good Jan. 20, 1959, and "Device for Removing Irregularities from a Ground Covering", U.S. Pat. No. 3,168,150 to Kappler Feb. 2, 1965. These various heavy, large, and mechanical type devices heretofore known suffer also from a number of disadvantages:

(h) The mechanical types are extremely complex with numerous moving parts which often break or rust.

(i) The mechanical types are too noisy to use while golfers are putting.

(j) The various heavy, large, and mechanical type devices are too heavy and large to be carried by individual golfers.

(k) These devices are too expensive to manufacture and maintain.

(l) These devices also require a paid golf course attendant to operate them.

(m) These devices can not be permanently stationed on the golf course, since they are affected by moisture, heat, and cold.

(n) These devices do not blend aesthetically with golf courses or golfing equipment.

(o) Since time is of the essence in repairing ball marks, by the time these various heavy, large, and mechanical type devices are brought to the greens by the maintenance staff, it is too late. A ball mark left unrepaired for one hour takes two weeks to mend.

OBJECTS AND ADVANTAGES

Accordingly, several objects and advantages of the present invention are:

(a) To provide a versatile golf tool which is elongated, self-supporting, rigid, quiescent, and leveraged for repairing ball marks and performing a variety of golf tasks.

(b) To provide a versatile golf tool which can be used by everyone, golfer and maintenance personnel alike, to rapidly repair ball marks without bending over.

(c) To provide a versatile golf tool which will not distract putters and the flow of the game, since it can be operated without sound and without up and down bending movements.

(d) To provide a versatile golf tool which visually reminds all players to repair ball marks.

(e) To provide a versatile golf tool which eliminates dirt and chemicals from contaminating golfers pockets and person.

(f) To provide a versatile golf tool which reduces the risk of being lost or misplaced.

(g) To provide a versatile golf tool which uses the leverage of a multi-faceted curved fulcrum head, allowing it to be manipulated in different directions to repair all different types of ball marks.

(h) To provide a versatile golf tool which is more highly visible for superior advertising capabilities.

(i) To provide a versatile golf tool which is simple to operate and has no moving parts, subject to corrosion and wear.

(j) To provide a versatile golf tool which is light, easily manipulated, and can be carried with normal golfing equipment by a golfer or mounted on golf carts.

(k) To provide a versatile golf tool which is inexpensive to operate, manufacture, and maintain.

(l) To provide a versatile golf tool which can stand by itself in order to be permanently stationed on the golf course for convenience and ease of use, without being affected by moisture, heat, and cold.

(m) To provide a versatile golf tool which is readily available to all players and maintenance personnel.

(n) To provide a versatile golf tool which can pick up leaves and other debris from the course without bending over.

Further objects and advantages are to provide a versatile golf tool which is more efficient and convenient with a comfortable grip, easy to use shape, allowing it to fix all different types of ball marks helping the appearance and smoothness of greens, able to stand by itself, allowing it to hold up other golfing equipment, with a flag which shows direction and velocity of wind, which can be used as a practice target pin, can be used to clean grass and dirt off spikes and club grooves, and is aesthetically compatible with golf courses and other golfing equipment. Still further objects and advantages will become apparent from a consideration of the drawings and ensuing description of it.

DRAWING FIGURES

In the drawings, closely related figures have the same numbered parts.

REFERENCE NUMERALS IN DRAWINGS

Figure 1:
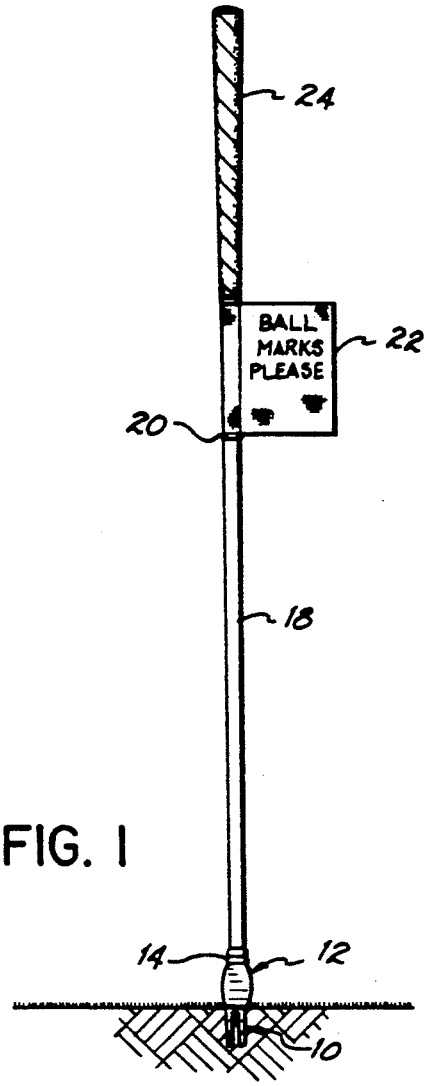
FIG. 1 shows a front elevational view of the versatile golf tool standing by itself on a golf course green.

10: tines
11: base
12: multifaceted curved fulcrum head
14: collar
16: neck
18: shaft
20: ring
22: flag
24: grip

DESCRIPTION OF THE PREFERRED EMBODIMENT OF FIGS. 1 TO 4

The preferred embodiment of the versatile golf tool of the present invention is illustrated in the drawings, FIGS. 1 to 4. The versatile golf tool has two tines 10, made of steel, flat and rounded on their distal tips so as not to be sharp. Tines 10 are typically 31 mm long and 1 mm to 2 mm thick. These are used for insertion into the grass on the edge of a ball mark. Tines 10 and a base 11 are one piece. Base 11 is used as the anchor to hold tines 10 firmly inside a multifaceted curved fulcrum head 12, which is shown most clearly in FIG. 3 and FIG. 4. Multifaceted curved fulcrum head 12, cast in aluminum is gently rounded and angled at 30° to 45° on the back and 30° to 40° on the sides to provide the subtle leverage necessary for lifting and closing the depressed grass back to level without leaving a dent. Head 12 is approximately 26 mm wide and 50 mm long and 13 mm thick. Front of head 12 is flat.

Figure 2:
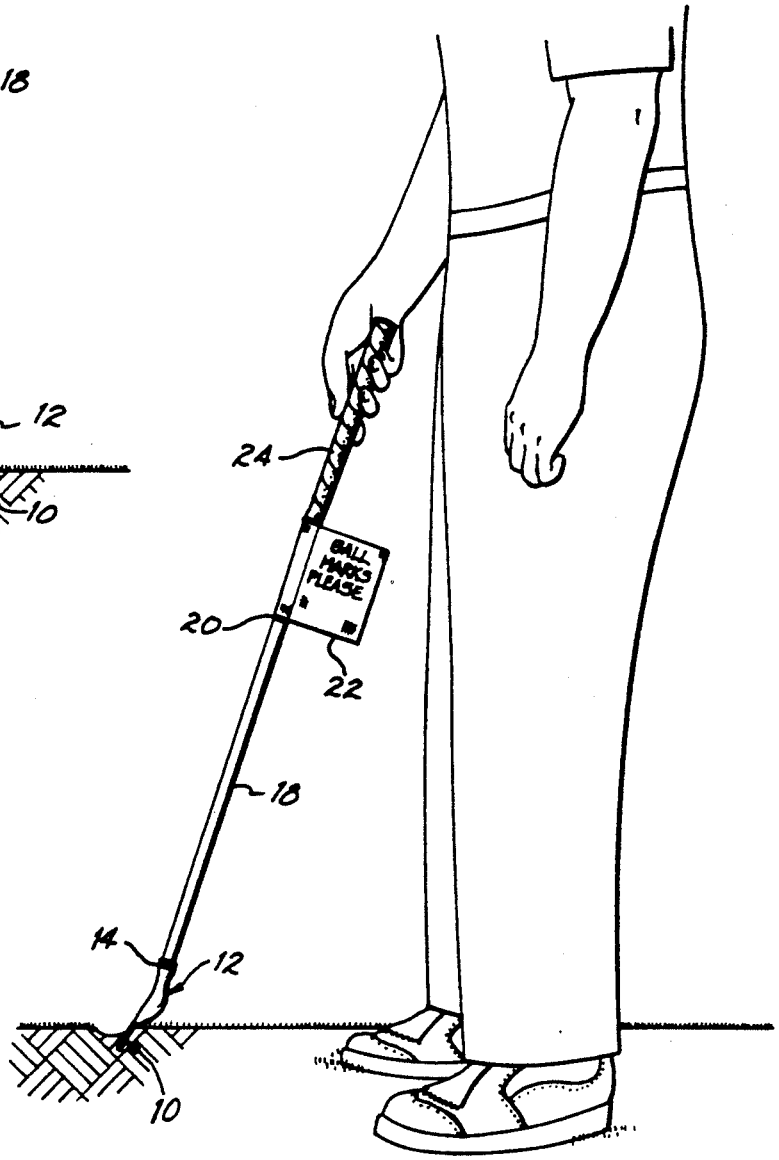
FIG. 2 shows a side elevational view of the versatile golf tool being used by a person standing with the tool in position to repair a ball mark.

A collar 14, which is formed with multifaceted curved fulcrum head 12 in the casting process is round and has a circumference of 54 mm. The proximal edge of collar 14 is flat and provides a firm footing where a shaft 18 meets with collar 14. A neck 16, formed with multifaceted curved fulcrum head 12 and collar 14 in the casting process is cylindrical in shape with a diameter of 12 mm. Neck 16 can be inserted and fastened permanently into shaft 18 using an adhesive. Shaft 18 is aluminum and is electro-static color coated. As shown in FIG. 1 and FIG. 2 a ring 20 is rubber and fits around shaft 18 preventing a flag 22 from sliding down shaft 18. Flag 22 is rip-stop nylon, imprinted with a message to remind golfers to repair ball marks and has room for imprinted logos and advertising. Flag 22 is sewn to fit around shaft 18. A grip 24 is flat on front side, rounded on back side, and made of thermo-plastic material. Grip 24 is attached to shaft 18 using double stick tape. Flat portion of grip 24 is aligned with front flat side of multifaceted curved fulcrum head 12.

From the description above, a number of advantages of the versatile golf tool become evident:

(a) This extremely light versatile golf tool can be used by golfers and maintenance personnel to rapidly repair ball marks without bending over.

(b) This versatile golf tool has no moving noisy parts.

(c) Flag 22 provides a visual reminder to all players to fix ball marks and provides superior advertising capabilities.

(d) This versatile golf tool provides a multi-faceted curved fulcrum head 12 allowing the user to manipulate and repair the grass around any type ball mark.

(e) The versatile golf tool's shape, materials, and light weight allow it to stand by itself and not subject to damage by weather conditions.

(f) The versatile golf tool is extremely compatible in its look and method of use with other golfing equipment, thus the versatile golf tool does not look out of place on the golf course and can be carried with other golfing equipment.

(g) The versatile golf tool allows ball marks to be fixed and shoe spikes to be cleaned without dirt or chemicals contaminating the users hands and clothing.

(h) The versatile golf tool allows the user to pick up leaves and debris without bending.

(i) The versatile golf tool's ability to stand by itself allows it to be used as a practice target and it can hold up other golfing equipment.

DESCRIPTION OF OPERATION OF FIGS. 1 TO 4

With the parts designed and assembled as shown and described, the versatile golf tool can be positioned to stand by itself on a golf course as shown in FIG. 1. The user grasping the tool by grip 24 positions the tool vertical to the ground and pushes tines 10 penetrating the ground surface to a point where multi-faceted curved fulcrum head 12 contacts the ground, stopping further penetration. With tines 10 below the ground and multifaceted curved fulcrum head 12 above the ground, the tool stands firmly in a vertical position allowing the user to release his hold. The tool then stands by itself as illustrated in FIG. 1. With the tool in a vertical position, standing by itself, flag 22 is a visual reminder to repair ball marks and is an indicator of direction and velocity of wind. In this vertical position any imprinted logos or advertising on flag 22, grip 24, and shaft 18 can be seen. With the tool in this vertical position, it can be used as a practice target. It can be used to hold up other golfing equipment such as a towel, hat, glove, or other golf clubs. This reminds players not to forget their equipment when leaving the green. With the tool in this position, it is readily available for use by anyone and can be repositioned anywhere. The motion of positioning and repositioning the tool vertically into the ground aerates the turf and leaves no dents. In this vertical position, ring 20 prevents flag 22 from sliding down shaft 18.

The user shown in FIG. 2 holding the versatile golf tool by grip 24 is in position to use the tool to repair ball marks without bending over. Since all ball marks are different, the shape and angles of multi-faceted curved fulcrum head 12 allows for the use of different movements to repair these different marks. Ball marks which are mere indentations of the surface can be repaired by inserting tines 10 at the near outer perimeter of the ball mark with shaft 18 in a predominantly vertical position and the flat side of grip 24 facing away from the user to a point where multi-faceted curved fulcrum head 12 touches the turf. The user holding grip 24 can move shaft 18 back towards himself. This motion allows the back of multi-faceted curved fulcrum head 12 to act as its own fulcrum, lifting tines 10 below the indentation returning the turf to level. Ball marks which penetrate through the turf exposing dirt can be repaired by inserting tines 10 at the near outer perimeter of the ball mark with shaft 18 in a predominately vertical position and the flat edge of grip 24 facing away from the user, to a point where multi-faceted curved fulcrum head 12 touches the turf. The user twists shaft 18 using his hand on grip 24 to the right or left allowing the sides of multi-faceted curved fulcrum head 12 to act as its own fulcrum forcing tines 10 to push the grass and roots of the displaced turf back into level position covering the dirt. The user can also kick the back of multi-faceted curved fulcrum head 12 when tines 10 are inserted to close a large dirt exposed ball mark.

Figure 3:
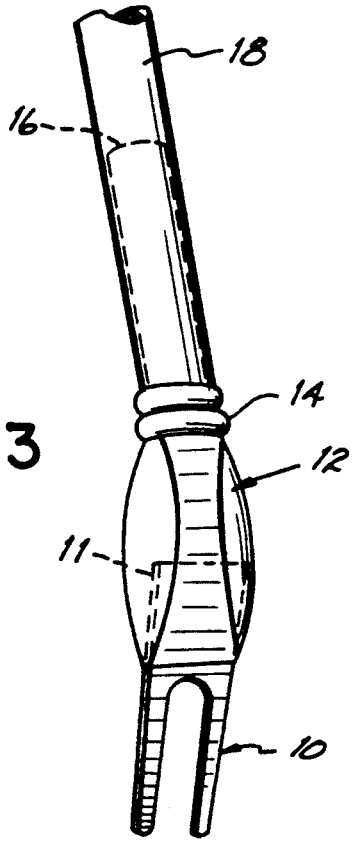
FIG. 3 is a perspective view of the lower portion of the versatile golf tool showing the details of tines, base, multifaceted curved fulcrum head, collar, neck, and shaft.
Figure 4:
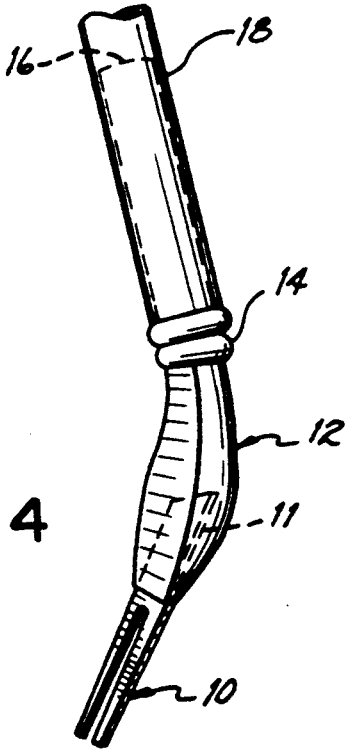
FIG. 4 is another perspective view similar to FIG. 3 showing the details of tines, base, multifaceted curved fulcrum head, collar, neck, and shaft.

In FIG. 3 and FIG. 4 multi-faceted curved fulcrum head 12, collar 14, and neck 16 are all formed together in the casting process. Collar 14 provides a flat footing, preventing shaft 18 from reaching multi-faceted curved fulcrum head 12 when neck 16 is inserted into shaft 18. Neck 16 is fastened inside shaft 18 with permanent adhesive. Base 11 is cast inside multi-faceted curved fulcrum head 12 supporting tines 10.

The thermo-plastic material of grip 24 remains comfortable to the touch in extreme weather conditions. As clearly seen in FIG. 2, the user holding the versatile golf tool by grip 24 can clean dirt out of shoe spikes and club grooves, pick up leaves and debris, and quickly repair numerous ball marks without making a sound or any up and down motion to disturb other putters. Tines 10 and multi-faceted curved fulcrum head 12 will not contact the users hands or clothing.

SUMMARY, RAMIFICATIONS, AND SCOPE

Accordingly, the reader will see that the versatile golf tool of this invention can be used to repair ball marks and provide other golf related functions easily, quickly, quietly, and conveniently without distraction. It is less expensive to manufacture and maintain since it has no moving parts, which are subject to breakage or corrosion. The versatile golf tool's appearance allows it to blend with other golf course equipment and thus, can be permanently stationed on the golf course or golf carts. Since it resembles golf clubs and is extremely light weight, it can be carried by golfers conveniently in their bags, reducing the need for paid maintenance personnel. Furthermore, the versatile golf tool allows for the repairing of a greater number of ball marks in less time and with less effort, since no bending is necessary.

The versatile golf tool provides a constant visual reminder to all players to repair ball marks and at the same time, provides a vehicle for advertising.

The versatile golf tool provides a practice target, a wind direction and velocity gauge, and a holder for other golfing equipment, since it has the ability to stand by itself.

Although the description above contains many specificities, these should not be construed as limiting the scope of the invention but as merely providing illustrations of the presently preferred embodiment of this invention. Many other variations are possible for example, the grip can be made of other materials such as leather or rubber. The shaft can be made of wood, fiberglass etc. The multi-faceted curved fulcrum head, collar, neck, and tines can be all one piece and can be made out of other materials such as steel or plastics. Slightly different shapes, sizes, and colors can also be used.

Thus, the scope of the invention should be determined by the appended claims and their legal equivalents, rather than by the examples given.

We claim:

1. An elongated multi-directional leverage tool for golf tasks, comprising:

a rigid fulcrum head, having top, bottom and side surfaces, said side surfaces of said fulcrum head sloping upwardly and outwardly from said bottom surface to said top surface, said fulcrum head having a lower and upper end, a plurality of tines protruding from said lower end, each tine having a top surface and a bottom surface, said bottom surface of said fulcrum head extending below a lowermost bottom surface of said plurality of tines to provide leverage when said tines are inserted into the ground and manipulated during a golf repair task, and an elongated shaft being attached to the upper end of said fulcrum head, said bottom surface of said fulcrum head sloping toward said lowermost bottom surface of said plurality of tines at said lower end and forming an obtuse angle with respect to said lowermost bottom surface to provide for a smooth transition between said bottom surface of said fulcrum head and said lowermost bottom surface of said plurality of tines.

2. The tool of claim 1 further including a grip attached to said shaft at the end opposite from where said fulcrum head is attached, whereby a user can hold the grip and manipulate the tool in an upright position to perform golf tasks.

3. A rigid multi-directional leverage tool for golf tasks, comprising:

a rigid fulcrum head having top, bottom and side surfaces, said side surfaces of said fulcrum head sloping upwardly and outwardly from said bottom surface to said top surface, said fulcrum head having a lower end, a plurality of tines protruding from said lower end, each tine having a top surface and a bottom surface, said bottom surface of said fulcrum head extending below a lowermost bottom surface of said plurality of tines to provide leverage when said tines are inserted into the ground and manipulated during a golf repair task, said bottom surface of said fulcrum head sloping toward said lowermost bottom surface of said plurality of tines at said lower end and forming an obtuse angle with respect to said lowermost bottom surface to provide for a smooth transition between said bottom surface of said fulcrum head and said lowermost bottom surface of said plurality of tines.

4. The device of claim 3 wherein said fulcrum head has an upper end, said upper end having means for being rigidly attached to a shaft.

* * * * *